US005564632A

United States Patent [19]

Prohazka

[11] Patent Number: 5,564,632

[45] Date of Patent: Oct. 15, 1996

[54] SECONDARY AIR NOZZLE AND STARTING BURNER FURNACE APPARATUS

[75] Inventor: George J. Prohazka, Simsbury, Conn.

[73] Assignee: Combustion Engineering, Inc., Windsor, Conn.

[21] Appl. No.: 364,871

[22] Filed: Dec. 27, 1994

[51] Int. Cl.[6] ..... F23D 11/40; B05B 1/32

[52] U.S. Cl. ..... 239/420; 239/425; 239/505; 239/456; 110/300; 110/245

[58] Field of Search ..... 239/521, 523, 239/434.5, 417, 420, 425, 451, 456, 423, 424.5, 434, 505; 110/297, 348, 182, 300, 245

[56] References Cited

U.S. PATENT DOCUMENTS

| | | | |
|---|---|---|---|
| 411,379 | 9/1889 | Gordon | 110/300 |
| 1,132,471 | 3/1915 | Hackmann | 239/434.5 X |
| 2,368,178 | 1/1945 | Turpin | 239/417 |
| 2,591,188 | 4/1952 | Nilsson | 239/434.5 X |
| 5,039,018 | 8/1991 | Olsson | 239/434.5 X |
| 5,174,226 | 12/1992 | Martin et al. | 110/297 |

*Primary Examiner*—Kevin Weldon
*Attorney, Agent, or Firm*—Robert S. Smith

[57] ABSTRACT

An air nozzle assembly for use in an associated combustion apparatus which includes a secondary air nozzle apparatus. The air nozzle apparatus may be a part of the windbox of an associated furnace. The apparatus includes a housing which has at least a part thereof disposed surrounding a first axis. The part has respective first second third and fourth cross-sectional areas at first, second, third and fourth axially spaced planes that are perpendicular to and axially spaced along the first axis of the part of the housing. The cross sectional area of each of the first second third and fourth cross-sectional areas each different from each other of the cross sectional areas. The apparatus also includes a diffuser member; apparatus for supporting the diffuser; and apparatus for moving the apparatus for supporting along a second axis, the second axis is parallel to the first axis. In some forms of the invention the diffuser member is a rotationally symmetrical object which may be a truncated conical body. The apparatus for supporting the diffuser is a cylindrical member in some forms of the invention.

18 Claims, 5 Drawing Sheets

SECONDARY AIR NOZZLE AND STARTING BURNER FURNACE APPARATUS

BACKGROUND OF THE INVENTION

The invention relates to nozzles used in furnace apparatus. While the invention has particular application to chemical recovery units it also has application to other slagging furnaces and other furnace apparatus. Although the chemical recovery boiler shares its general appearance and many of its physical components with power-boilers, it is unique in the power-generation field. Such boilers have a three purposes. The first is to reduce the sulfur compounds in the black liquors to sodium sulphide. The second is to recover inorganic chemicals from the black liquor to be recycled in a pulping process. The third is to combust the organic constituents in the black liquor to produce valuable steam. For example, the efficient recovery of the inorganic pulping chemicals and the efficient generation of steam from the chemical recovery boiler are both essential elements in the economic and environmental aspects of the kraft pulping process.

Chemical recovery units, used in the pulp industry, utilize the liquor obtained from the digestion of wood or other cellulose material with certain chemicals. The liquor in such processes is sprayed into the furnace of the unit. The combustible portion of the liquor is burned and the chemicals in the liquor are smelted and drawn off of the lower end of the furnace. In typical chemical recovery units the heat that is evolved by burning the liquor is used to reduce the sulfur compounds and to generate steam by passing the combustion gas over suitable heat exchange surfaces.

This liquor often has a substantial moisture content. Most of the moisture is driven from the liquor spray upon the introduction of the liquor into the furnace because of the high temperature in the furnace. The hot gases originating from the bottom of the furnace will pass upwardly through the furnace. The solid particles fall onto the furnace hearth and form a pile. During the descent to the hearth some of the volatile substances are driven from these solid particles. The combustible material in the solids is burned in the pile that forms on the hearth. This combustion is supported by the introduction of preheated primary air which is directed generally over and upon this pile of material. The volatile matter and the combustibles contained in this solid material are burned. The remaining inorganic chemicals are melted and the sulfur compounds are reduced to sodium sulfide. Only the non-combustible material which includes the chemicals that are to be recovered along with the traces of various impurities are removed through a suitable spout.

In addition to primary air referred to above it is common practice to provide secondary air and tertiary air to control the combustion process. The present invention has particular application to controlling the flow of such secondary and tertiary air.

In the operation of a slagging furnace, such as a chemical recovery furnace, the amount of combustion air required is proportional to the quantity of fuel being burned. Conventional nozzles through which air is introduced have no moving parts. They are fixed in number and fixed in area. In such nozzles, air velocity through the nozzle will therefore be a function of the quantity of the fuel being burned. This means that the penetration of the air stream from the respective nozzles at low combustion rates will be greatly reduced. This may result in odorous emissions and other consequences of poor air distribution and insufficient furnace turbulence may result.

Variable area nozzles known in the industry operate by closing off the top of the fixed nozzle by lowering a damper or guillotine. Such apparatus has not been wholly satisfactory for the following reasons:

1. Conventional dampers tend to be difficult to move because of the sliding friction involved in moving the damper.
2. Conventional variable area nozzles have moving parts that are close to the furnace opening and thus tend to overheat and become jammed as the result of thermal distortion.
3. The moving parts of conventional variable area nozzles are close to the furnace opening and thus are continually exposed to the hot ash and molten smelt. Accordingly, slag runs down the wall and freezes on the moving parts when the molten smelt and hot ash are exposed to the lower temperatures of the combustion air passing through the nozzle.
4. Closing off the top of the furnace opening in conventional variable area nozzles allows the molten smelt to run down into the inactive area of the nozzle and freeze. As a result, the damper is locked into the closed portion by the frozen smelt. The frozen smelt is inaccessible to poke rods because the damper obstructs access.
5. Thermal expansion of the air duct connecting the windbox to the nozzle acts to distort the nozzle shape which then causes binding of the control damper.

It is an object of the invention to provide apparatus which will be substantially insensitive to the effect of thermal expansion and contraction of the component parts.

Still another object of the invention to provide apparatus will have relatively little friction.

Another object of the invention is to provide apparatus which has moving parts which are located further away from the hot ash and molten material that are present in the interior of the furnace.

Still another object of the invention is to provide apparatus which will minimize pulling hot furnace gases into the nozzle and thus minimizes the occurrence of overheating and plugging as a result of pulling such gases into the nozzle.

SUMMARY OF THE INVENTION

It has now been found that these and other objects of the invention may now be attained in an air nozzle assembly for use in an associated combustion apparatus which includes a secondary air nozzle apparatus. The air nozzle apparatus may be a part of the windbox of an associated furnace. The apparatus includes a housing which has at least a part thereof disposed surrounding a first axis, the part having respective first second third and fourth cross-sectional areas at first, second, third and fourth axially spaced planes that are perpendicular to and axially spaced along the first axis of the part of the housing. The cross sectional area of each of the first second third and fourth cross-sectional areas each different from each other of the cross sectional areas. The apparatus also includes a diffuser member; means for supporting the diffuser; and means for moving the means for supporting along a second axis. The second axis being parallel to the first axis.

In some forms of the invention the diffuser member is a rotationally symmetrical object which may be a truncated conical body. The means for supporting the diffuser may be a cylindrical member.

BRIEF DESCRIPTION OF THE DRAWINGS

The invention will be better understood by reference to the accompanying drawing in which.

DESCRIPTION OF THE PREFERRED EMBODIMENT

A chemical recovery boiler shares the general appearance and many of the physical components with a power boiler. Typically, such apparatus must generate steam for paper-mill power and process demands and must chemically restore the inorganic components of a black liquor to a form that can be reprocessed into the chemicals required by the digester. The chemical recovery unit is an integral part of the kraft pulping process that process produces long-fiber pulp used in making high-strength paper.

Figure 1:
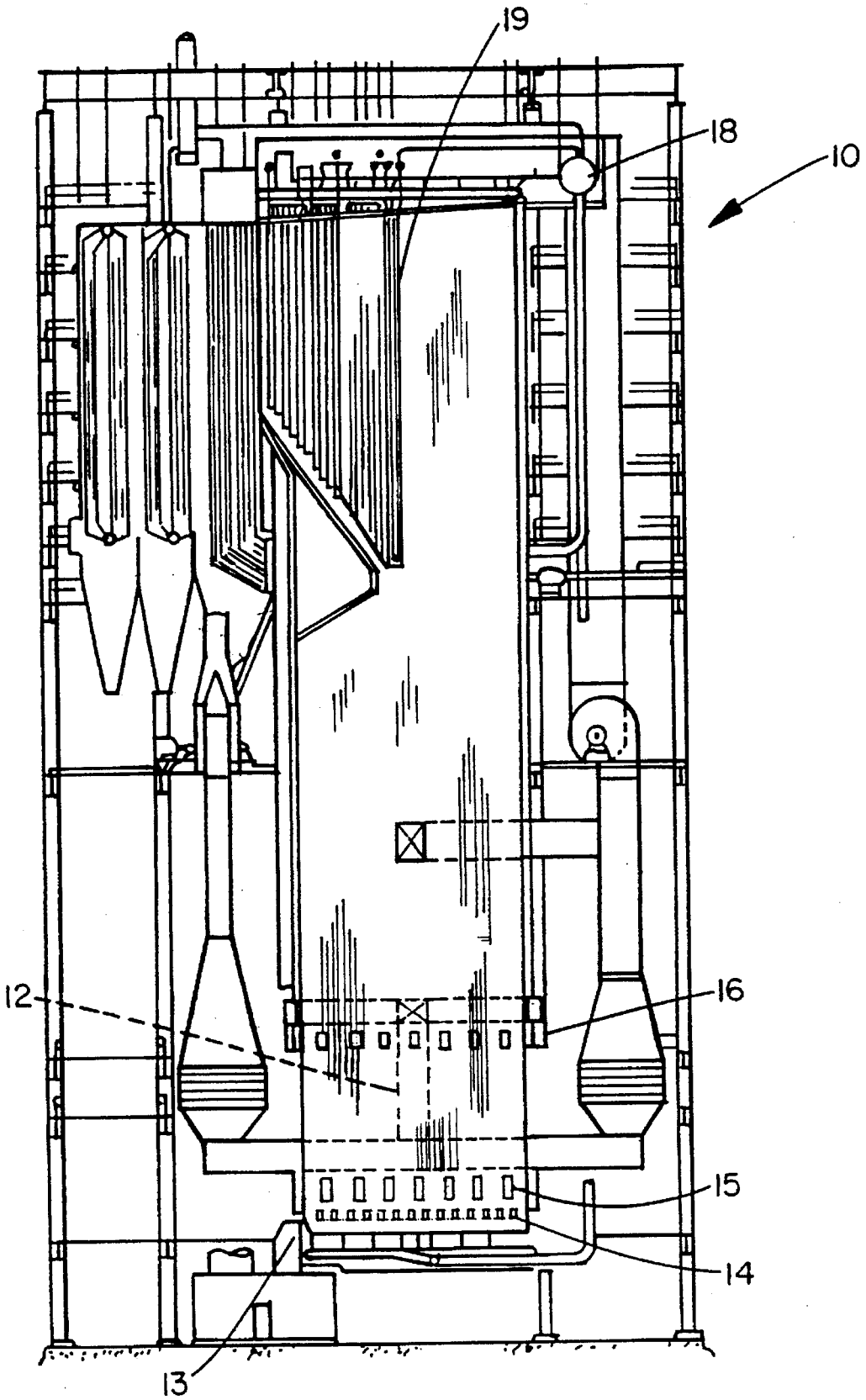
FIG. 1 is a diagrammatic representation of a vertical section of a chemical recovery unit into which the present apparatus may be installed.
Figure 2:
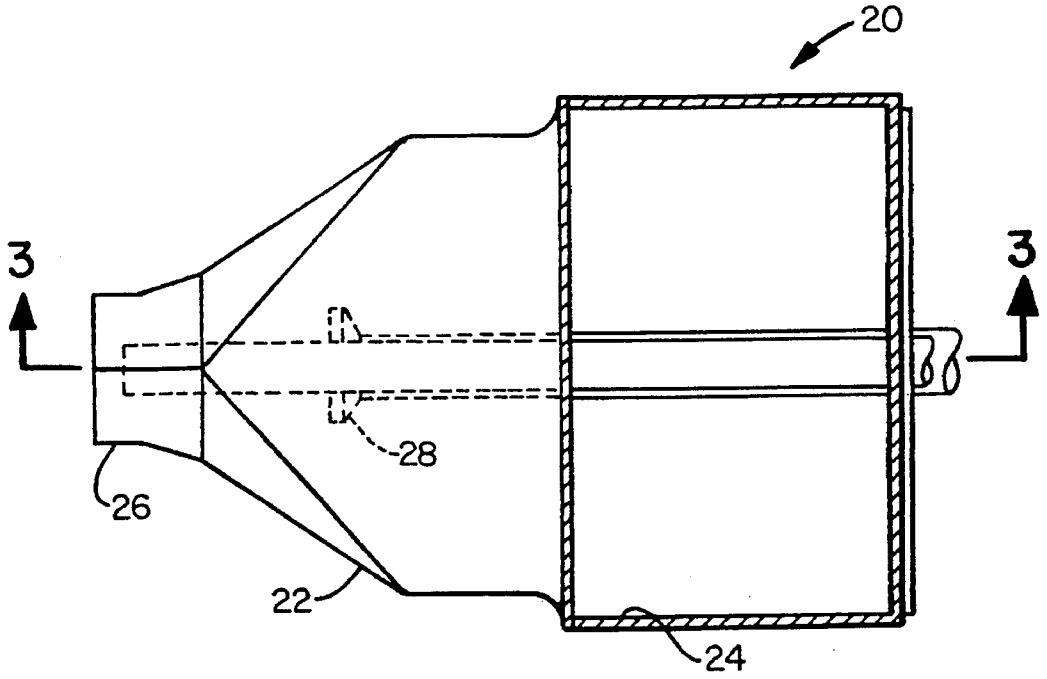
FIG. 2 is a plan view of the nozzle assembly in accordance with the preferred form of the invention.

Referring now to FIG. 1 there is shown a chemical recovery unit furnace 10 into which residual liquor obtained in a chemical digestion process is introduced through the openings 12, 12 by means of suitable nozzles not shown. This liquor which has been suitably concentrated prior to its introduction descends towards the furnace bottom. During the descent moisture is driven from the liquor and portions of the liquor burn. The dried liquor collects on the bottom or hearth of the furnace where the burning continues with molten chemical being withdrawn through a spout 13. Combustion supporting air is directed generally at the pile of char and fused materials on the bottom of the furnace through the primary air openings 14 with additional combustion supporting air being directed into the furnace through secondary air openings 15 and tertiary air openings 16.

The furnace 10 has the walls thereof lined with steam generating tubes which are connected at the upper ends with a steam and water drum 18 which forms part of the boiler or steam generating portion of the chemical recovery unit furnace 10. At the rear (the left side as viewed in FIG. 1) of the upper end of the furnace 10 is provided an opening through which the combustion gases pass. More particularly these gases pass through the vertically disposed gas pass 19 to downstream heat transfer surfaces.

In a typical arrangement a black liquor is sprayed into the furnace through a plurality of black-liquor spraying nobles 12 (one shown) disposed around the chemical recovery unit furnace. The liquor is typically evaporated to a firing concentration of about 65–75% solids prior to being sprayed. Primary air is introduced through openings 14 simultaneously from four sides of the furnace at a lower level of about three and a half feet above the furnace bottom. Secondary air is introduced through a plurality of registers 15 typically that are disposed at a higher elevation than the primary air openings 14.

Tertiary air nozzle openings 16 are disposed above the secondary air registers 15. Secondary and tertiary air is necessary for some applications to complete the combustion process. For the details of the construction of such apparatus reference is made to Combustion Fossil Power Systems, A Reference Book on Fuel Burning and Steam Generation edited by Joseph G. Singer and published by ABB Combustion Engineering, 1000 Prospect Hill Road, Windsor, Conn., Copyright 1991.

Referring now to FIGS. 2 through 9 herein, there is shown a preferred embodiment of the improved secondary air nozzle 20 in accordance with the invention. Respective nozzles of this type are disposed to direct air into each secondary air opening 15 of the furnace 10. Each nozzle includes a housing 22 having a generally L-shaped cross section as best seen in the sectional view of FIG. 3 which has been taken along the line 3—3 of FIG. 2. The housing 22 has an inlet 24 and an outlet 26. The L-shaped cross-section shown in FIG. 3 will be understood to include a first generally horizontal leg that includes the outlet 26 and a second generally vertical leg that includes the inlet 24.

Disposed within the housing 22 is a truncated conical plug 28 carried on the left (as viewed) axial extremity of an elongated first tube 30. As will be apparent by the shading of the truncated conical plug 28 in FIG. 3 and the end views of FIGS. 4–7 that the plug 28 has rectilinear opposed sides **28*a* and arcuate opposed ends 28*b***.

Figure 3:
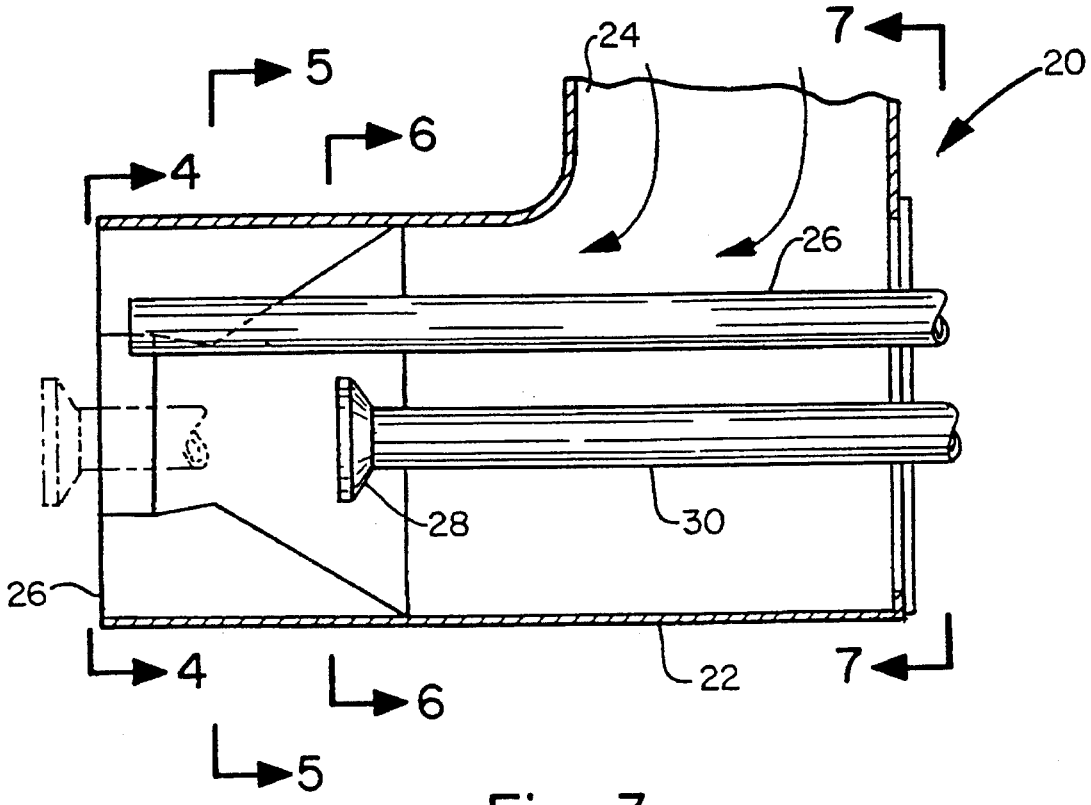
FIG. 3 is a side elevation in section, taken along the line 3—3 in FIG. 2.
Figure 4:
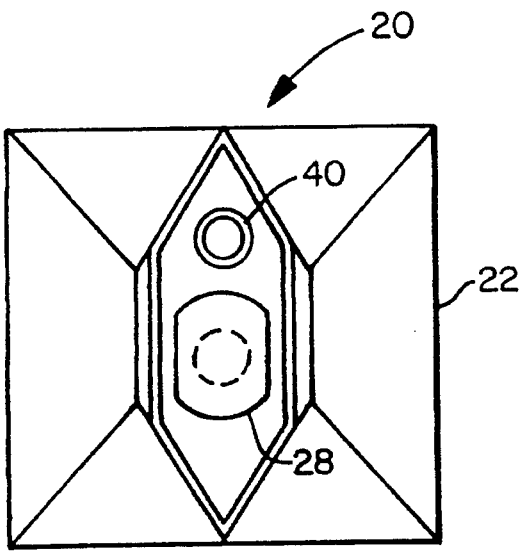
FIG. 4 is a front view, taken along the line 4—4 of FIG. 3, of the apparatus shown in FIG. 1.
Figure 6:
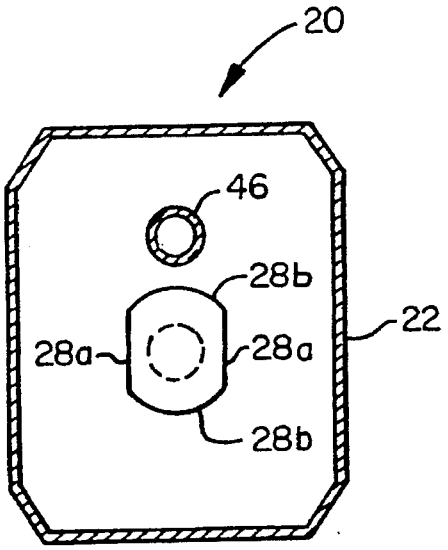
FIG. 6 is a sectional view taken along the line 6—6 of FIG. 3.
Figure 5:
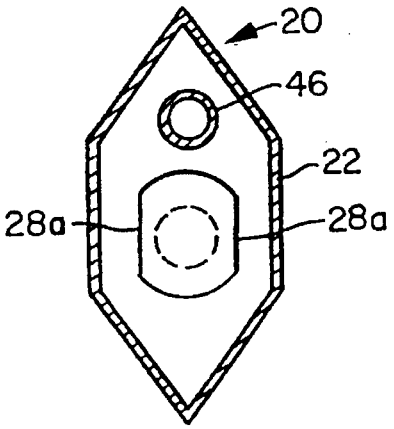
FIG. 5 is a sectional view taken along the line 5—5 of FIG. 3.
Figure 7:
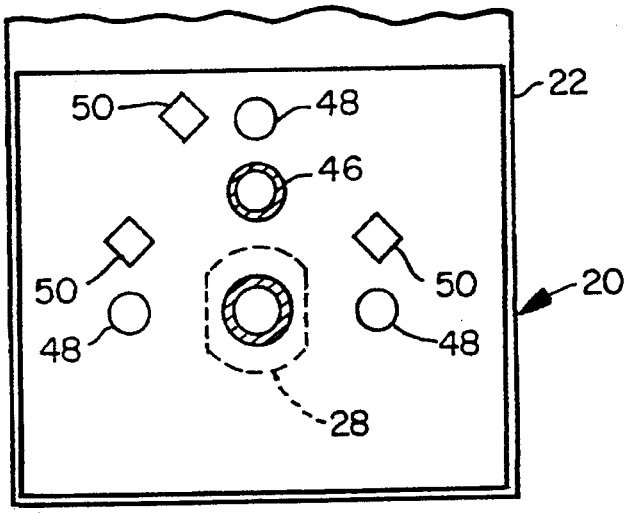
FIG. 7 is a rear elevational view taken along the line 7—7 of FIG. 3.

It will be apparent from the drawings that the cross-sectional area of the horizontal leg of the housing 22 has cross-sections at various axial points that vary substantially. For example, it will be apparent that the cross-sectional within the housing 22 area in the plane indicated by the line 4—4 in FIG. 3 is (a) smaller than the area at the cross-section indicated by the line 5—5 in FIG. 3 and (b) smaller than the area at the cross-section indicated by the line 6—6 in FIG. 3. It will also be apparent from the drawing that the truncated conical plug 28 is constructed of rigid material and thus has a fixed or constant cross-sectional area, measured in a plane perpendicular to the axis of the lower leg of the housing 22. Thus, movement of the truncated conical plug 28 between respective axially spaced positions will vary the area intermediate the part of the outlet 26 of the nozzle 20 adjacent to the truncated conical plug 28. For a given air flow, the velocity of the air through the nozzle is a function of the intermediate area.

Figure 8:
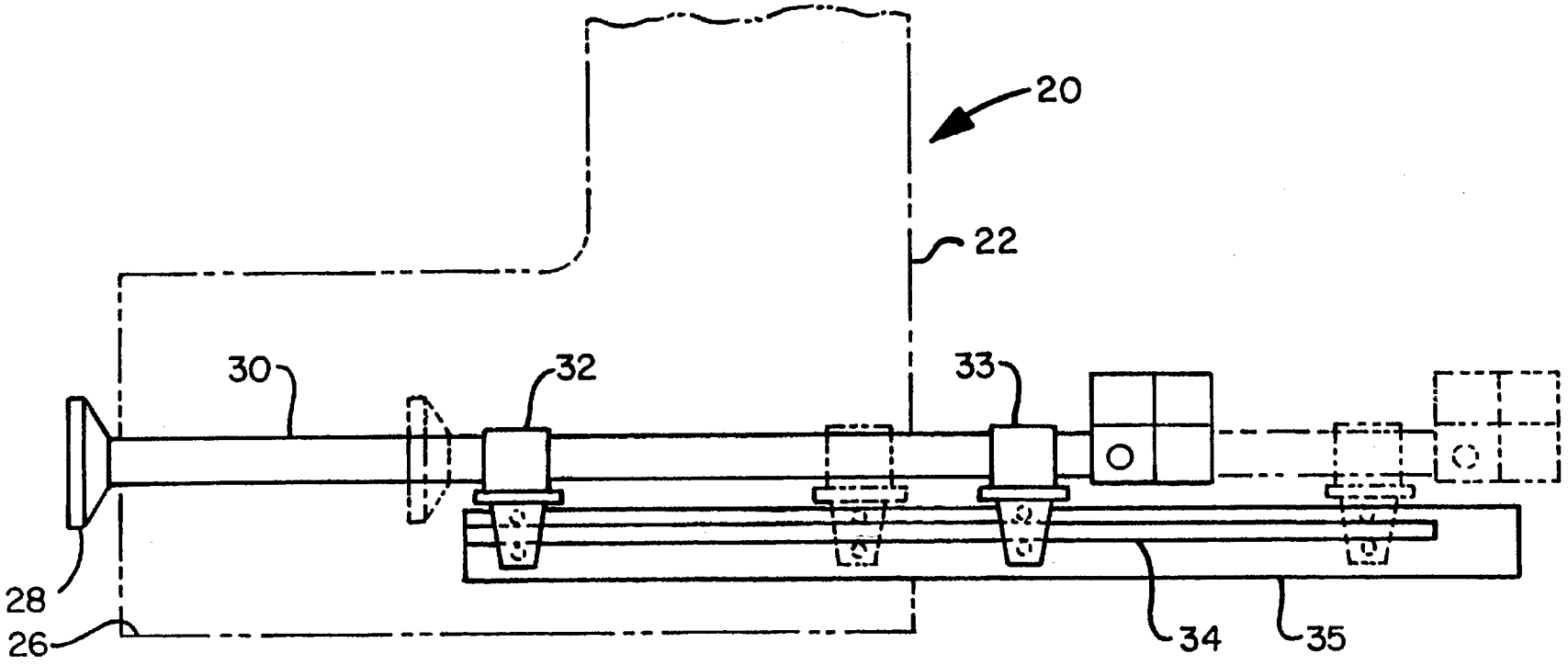
FIG. 8 is a side view, similar to FIG. 3, which also illustrates the mounting structure which provides for axial movement of the diffuser illustrated in FIGS. 2–7.

As best seen in FIG. 8, the elongated first tube 30 is carried by first and second trapezoidal rollers 32, 33. Each of the trapezoidal rollers 32, 33 engages a guide rail 34 whereby the elongated first tube 30 may be easily moved axially to position the truncated conical plug 28 at a desired position within the housing 22. Stated another way, the plug 28 is moveable axially along a first axis that is coincident with the geometric axis of the plug 28 and the tube 30.

Figure 9:
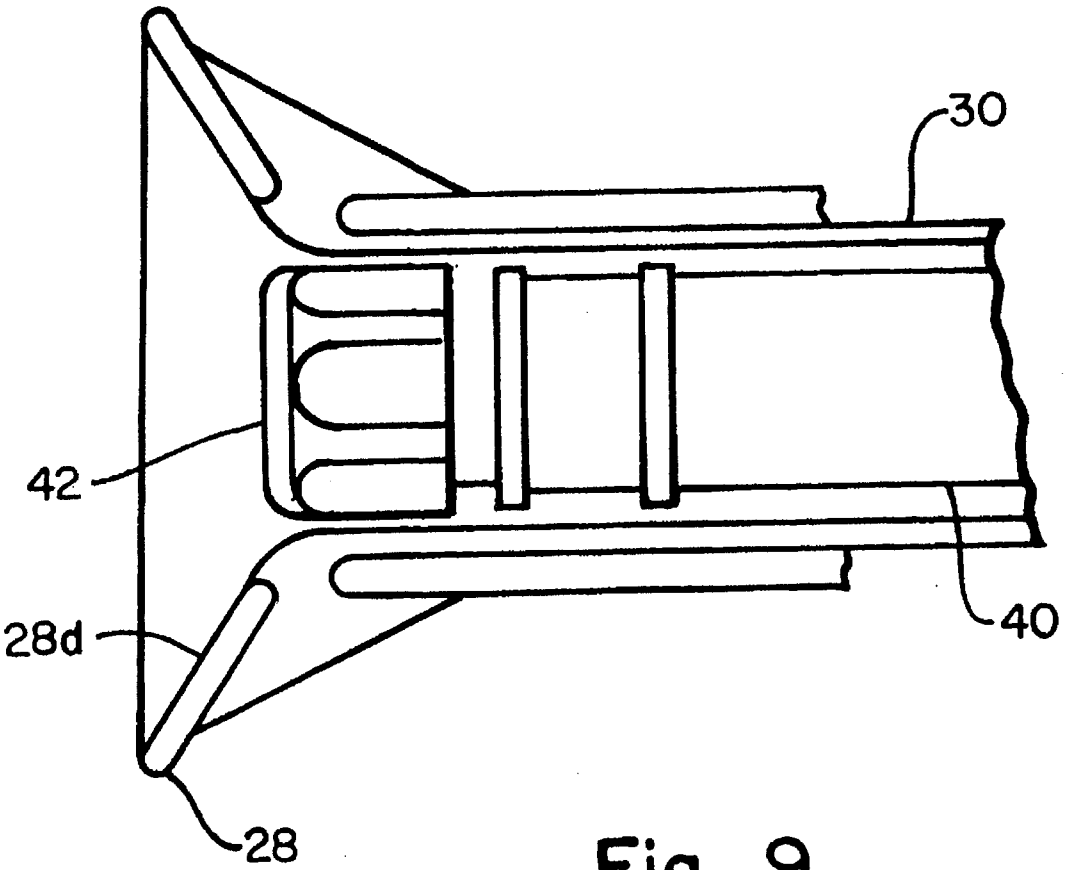
FIG. 9 is a side view to an enlarged scale of a portion of the oil delivery duct and the support structure which illustrates the relationship of the duct to the truncated conical diffuser.

As best seen in FIG. 9, there is smaller elongated second tube 40 disposed in concentric relationship to the elongated first tube 30. The left (as viewed) extremity of the elongated second tube 40 is provided with a cap 42 having a plurality of small holes (not shown) in the end face to disperse the oil that flows through the second tube 40 and out the cap 42. The apparatus in accordance with the present invention is a combination variable nozzle and a starting burner. Not all forms of the present invention will include both the variable nozzle and starting burner features. Some embodiments may include only the starting burner and some may include only the air diffuser. In the embodiments including the starting burner oil is provided under pressure to the second tube 40 by means of a flexible hoses (not shown) and conventional control apparatus will direct the oil into the second elongated tube 40 only when the left (as viewed) axial extremity of the elongated second tube 40 is proximate to the interior of the furnace. In other words, the oil, usually in combination with steam or compressed air, will be directed to the capped end of the second elongated tube 40 only when the left (as viewed) axial extremity of the second elongated tube 40 is near the most extreme left part of the possible travel thereof.

In the preferred embodiment the second elongated tube 40 is fixed to the first elongated tube 30 by suitable brackets (not shown). Thus, there is no relative motion between the first and second elongated tubes 30, 40. Ordinarily, the annular space intermediate the first and second elongated tubes 30, 40 is not used to conduct air or other fluids. The diameter of the first elongated tube 30 is chosen primarily to provide a sturdy support for the truncated conical plug 28 and to optimize the fluid dynamics of the air passing through the housing 22 and over the truncated conical plug 28.

As best seen in FIG. 9, the inner face 28*d* plug 28 is open and conical in shape to allow dispersion of the oil flowing through the cap 42. This shape is complimentary to the exterior truncated conical shape that disperses the air flowing along the exterior of the pipe 30 within the interior of the horizontal leg of the housing 20 before it passes out the outlet 26.

In FIG. 8 the solid line drawing illustrates the fully extended or left-most possible position of the truncated conical plug 28. Illustrated in phantom lines is the fully retracted position of the truncated conical plug 28 as well as the first elongated tube 30 with the pair of trapezoidal roller mounts 32, 33 and a longitudinal guide bar 34 therefor. Those skilled in the art will recognize that a view of the opposite side would be similar and thus would include the pair of trapezoidal roller mounts 32, 33 and the longitudinal guide bar 34, giving the diffuser assembly stability in the "roll" mode. The two sets of roller mounts 32, 34 and the longitudinal guide bar 34 provides stability in the "yaw" and "pitch" directions. The guide bar 34 is fixed to an elongated guide support.

It will be understood that the apparatus of the present invention provides an improved secondary air nozzle, which is a variable area air nozzle for introducing combustion air into a slagging furnace such as a chemical recovery boiler. In addition, the improved secondary air nozzle is combined with an integral starting burner in most embodiments.

The area of a secondary air nozzle is varied by changing the axial position of a conical plug within a tapered air nozzle opening. Varying the discharge area of the air nozzle allows the air velocity to be changed for a given amount of combustion air. The conical plug which is used to change the discharge area can be an auxiliary burner diffuser which can fire a liquid or gaseous fuel when in the fully extended position.

In operation, when the chemical recovery boiler is at rated capacity, a fully open air nozzle is required to supply the combustion air. For this condition, the burner diffuser is in a retracted position and the air velocity discharged into the furnace is at the optimum value for good penetration of the air stream from the nozzle into the interior of the furnace. At lower loads, when less combustion air is required, the diffuser on the end of the burner gun is advanced into the tapered air nozzle opening to the point where the open nozzle area will again result in the optimum air velocity into the furnace.

The burner gun can also function in a chemical recovery boiler as a starting burner, or as a load carrying burner capable of providing the heat to generate steam. In its fully extended position, a fuel control system (not shown) will allow fuel to flow into the inner tube 40. The apparatus in accordance with the invention includes an igniter 46 to light the oil. Air required for combustion of the fuel passes through the air nozzle and around the diffuser to provide the necessary recirculation zone for a clean flame.

A typical embodiment of the invention will include several rodding ports 48, to allow insertion of rods to break up material that may accumulate and harden, and several sight glasses 50 that permit visual observation of the operation.

It will be understood that in the operation of a recovery furnace, the amount of combustion air required is proportional to the rate at which fuel is burned. The nozzles through which air is introduced are conventionally fixed in number and each is fixed in area and typically cannot be closed off in operation. Air velocity through the nozzles will therefore be proportional to the firing rate. As a consequence, the penetration of the air stream from the nozzle into the interior of the furnace at low loads will be greatly reduced. Accordingly, odorous emissions and other consequences of insufficient furnace turbulence result. The present apparatus permits reduction of the nozzle area at lower loads and thus makes it possible to maintain jet velocity, and furnace turbulence through a range of operation.

The moving parts of the apparatus in accordance with the present invention are the diffuser and the support mechanism. Except for the diffuser and the air nozzle walls, all parts are located at the back of the windbox away from the intense heat of the furnace interior. Those skilled in the art will recognize that the nozzle of the present invention is a part of the windbox. In other words, the windbox is the housing 22 which includes the inlet 24.

When the diffuser is restricting the area of the nozzle, air at high velocity will flow between the outer edge of the diffuser and the surface of the air nozzle. This ring of high velocity air follows the nozzle wall, and will tend to push away the furnace slag, preventing it from entering the nozzle. The air jet also cools the diffuser and nozzle wall and thus prevents them from overheating. In the normal operating range, air velocity will be in the order of 200 to 240 feet/second. At this velocity, there is a sweeping action which will tend to prevent any slag buildup. Since the diffuser is completely surrounded by the air it is not likely to become jammed or be locked in position by accumulation, or become jammed by thermal distortion. It is not important that the diffuser 28 be exactly centered in the air nozzle 20. Even if some thermal distortion of the windbox should occur, there is sufficient clearance between the diffuser and the nozzle wall to prevent contact or binding. When the diffuser 28 is in its retracted position, it does not restrict the nozzle opening. In that position, furnace radiation is insignificant so the diffuser is not vulnerable to overheating or distortion.

Whether the diffuser is retracted or in its advanced position, any accumulation of smelt on the air nozzle can be rodded off from the rodding ports 48 provided in the windbox back plate.

Starting burners, known in the prior art as well as the present invention, are located in the lower part of the furnace in a chemical recovery boiler. They are fired only during startup or shutdown of the furnace and during the rare occasions when the char bed combustion becomes unstable. Since starting burners are not fired most of the time, the air supply is turned off during normal operation of the recovery boiler.

As a consequence of not having sufficient air to adequately cool the burner, certain burner problems have become common with most prior art apparatus. These are:

1. Wastage of the air nozzle walls due to high temperature corrosion;

2. Plugging of the nozzle opening by smelt running down the furnace walls;

3. Entry of char and black liquor into the windbox. This material must be removed before the burner can be operated. Furthermore, the char causes the air inlet dampers to jam;

4. Burner igniter and fuel gun become plugged or damaged unless retracted. Manually retracting a gas gun is especially difficult because of its weight;

All of these problems can be either eliminated or significantly reduced by combining the function of the starting burner with the secondary air nozzle. Burnback, plugging, and entry of char into the unused burner is prevented because secondary air at high velocity always surrounds the burner gun and igniter. The air cools the nozzle, burner and igniter and sweeps them clean. It is expected that the axial position of the gun diffuser will be moved whenever the load on the boiler changes which could be quite often. A low friction support mechanism and power positioner can be provided with the burner gun to make this operation easier. In the apparatus of the present invention, the igniter and the fuel gun are always being cooled by the surrounding combustion air. This air movement prevents furnace gases, char, and black liquor droplets from landing on the igniter and diffuser.

The invention has been described with reference to its illustrated preferred embodiment. Persons skilled in the art of such devices may upon disclosure to the teachings herein, conceive other variations. Such variations are deemed to be encompassed by the disclosure, the invention being delimited only by the following claims.

Having thus described my invention, I claim:

1. A secondary air nozzle apparatus for an associated furnace which comprises:

a housing which has a passageway disposed therein surrounding a first axis, said passageway having respective first second third and fourth cross-sectional areas within said housing at first, second, third and fourth axially spaced planes that are perpendicular to and axially spaced along said first axis the cross sectional area of each of said first second third and fourth cross-sectional areas each being different from each other of said cross sectional areas;

a diffuser member;

means for supporting said diffuser; and means for moving said means for supporting along a second axis, said second axis being parallel to said first axis, said diffuser being movable to a plurality of positions within said passageway as well as to a plurality of positions outside of said passageway, said diffuser being dimensioned and configured to pass freely within said first, second, third and forth cross-sectional areas without touching any part said housing, said first cross-sectional area being at an axial extremity of said passageway, said second axial extremity being spaced from said first axial extremity, said third axial extremity being spaced further than said second axial extremity from said first axial extremity than said second axial extremity, said first axial cross section having a horizontal width that is smaller than the horizontal width of the second axial cross section, said first axial cross section having a vertical wall dimension that is larger than the second vertical wall dimension in the second axial cross section.

2. The apparatus as described in claim 1 wherein:

said diffuser member is a symmetrical object.

3. The apparatus as described in claim 2 wherein:

said diffuser member is a truncated conical body.

4. The apparatus as described in claim 3 wherein:

said means for supporting said diffuser is a cylindrical member.

5. A secondary air nozzle and windbox apparatus for an associated furnace which comprises:

a housing which has at least a part thereof disposed surrounding a first axis, said part having respective first second third and fourth cross-sectional areas at first, second, third and fourth axially spaced planes that are perpendicular to and axially spaced along said first axis of said part of said housing;

the cross sectional area of each of said first second third and fourth cross-sectional areas each being different from each other of said cross sectional areas;

a diffuser member;

means for supporting said diffuser; and means for moving said means for supporting along a second axis, said second axis being parallel to said first axis, said apparatus further including a conduit for oil, said conduit being concentrically disposed within said means for supporting, said conduit extending to through said diffuser member.

6. The apparatus as described in claim 5 wherein:

said means for supporting is a cylindrical body.

7. The apparatus as described in claim 6 wherein:

said diffuser member is a symmetrical object.

8. The apparatus as described in claim 7 wherein:

said diffuser member is a truncated conical body.

9. The apparatus as described in claim 8 wherein:

said means for supporting said diffuser is a cylindrical member.

10. A secondary air nozzle and furnace apparatus which comprises: a furnace; and a secondary air nozzle apparatus cooperating with said furnace that includes a housing which has a passageway disposed therein surrounding a first axis, said passageway having respective first second third and fourth cross-sectional areas within said housing at first, second, third and fourth axially spaced planes that are perpendicular to and axially spaced along said first axis, the cross sectional area of each of said first second third and fourth cross-sectional areas each being different from each other of said cross sectional areas; said nozzle apparatus including a diffuser member; means for supporting said diffuser; and means for moving said means for supporting along a second axis, said second axis being parallel to said first axis, said diffuser being movable to a plurality of positions within said passageway as well as to a plurality of positions outside of said passageway, said diffuser being dimensioned and configured to pass freely within said first, second, third and forth areas without touching any part said housing, said first cross-sectional area being at an axial extremity of said passageway, said second axial extremity being spaced from said first axial extremity, said third axial extremity being spaced further than said second axial extremity from said first axial extremity than said second axial extremity, said first axial cross section having a dimension measured in a first plane that is larger than the dimension of the second axial section measured in the first plane, said first axial cross section having a dimension measured in a second plane that is smaller than the dimension of the second axial section measured in the second plane.

11. The apparatus as described in claim 10 wherein:

said diffuser member is a symmetrical object.

12. The apparatus as described in claim 11 wherein:

said diffuser member is a truncated conical body.

13. The apparatus as described in claim 12 wherein:

said means for supporting said diffuser is a cylindrical member.

14. A secondary air nozzle and windbox apparatus and a furnace apparatus which comprises:

a furnace;

a housing abutting said furnace which has at least a part thereof disposed surrounding a first axis, said part having respective first second third and fourth cross-sectional areas at first, second, third and fourth axially spaced planes that are perpendicular to and axially spaced along said first axis of said part of said housing; the cross sectional area of each of said first second third and fourth cross-sectional areas each being different from each other of said cross sectional areas;

a diffuser member;

means for supporting said diffuser; and means for moving said means for supporting along a second axis, said second axis being parallel to said first axis, said apparatus further including a conduit for oil, said conduit being concentrically disposed within said means for supporting, said conduit extending to through said diffuser member.

15. The apparatus as described in claim 14 wherein:

said means for supporting is a cylindrical body.

16. The apparatus as described in claim 15 wherein:

said diffuser member is a symmetrical object.

17. The apparatus as described in claim 16 wherein:

said diffuser member is a truncated conical body.

18. The apparatus as described in claim 17 wherein:

said means for supporting said diffuser is a cylindrical member.

* * * * *